United States Patent [19]

Tanaka et al.

[11] 4,212,687

[45] Jul. 15, 1980

[54] ION-NITRITING PROCESS

[75] Inventors: Akio Tanaka, Ono; Mizuo Edamura, Kobe; Satoshi Furuitsu, Kakogawa; Satoru Kunise, Akashi, all of Japan

[73] Assignee: Kawasaki Jukogyo Kabushiki Kaisha, Kobe, Japan

[21] Appl. No.: 953,208

[22] Filed: Oct. 20, 1978

[30] Foreign Application Priority Data

Oct. 20, 1977 [JP] Japan ..... 52-126606

[51] Int. Cl.[2] ..... C21D 1/48

[52] U.S. Cl. ..... 148/16.6; 204/177

[58] Field of Search ..... 148/16.6; 204/177, 164

[56] References Cited

U.S. PATENT DOCUMENTS

| | | | |
|---|---|---|---|
| 3,389,070 | 6/1968 | Berghaus et al. | 148/16.6 |
| 3,761,370 | 9/1973 | Keller | 148/16.6 |

OTHER PUBLICATIONS

Metals Handbook, 8th Ed., vol. 2, American Society for Metals, p. 162.

*Primary Examiner*—L. Dewayne Rutledge
*Assistant Examiner*—John P. Sheenan
*Attorney, Agent, or Firm*—Fleit & Jacobson

[57] ABSTRACT

An ion-nitriding process in which workpieces are subjected to a two-step glow discharge in a nitrogen and hydrogen atmosphere, there being a larger nitrogen to hydrogen ratio in the second step.

5 Claims, 4 Drawing Figures

ION-NITRITING PROCESS

The present invention relates to ion-nitriding processes in which workpieces are subjected to glow discharges under an atmosphere of nitrogen-containing processing gas so that the gas is ionized and the resultant ions are bombarded upon the workpieces to effect nitriding.

Such ion-nitriding process has been known as being able to provide a finely nitrided surface layer in a very short time. In the process, the workpiece is subjected to bombarding of nitrogen and hydrogen ions to be heated thereby. Such ion bombarding causes the workpiece to release Fe atoms which produce compounds with N atoms in the atmosphere and the resultant compounds are deposited on the workpiece surface. It has also been recognized that the ion bombarding has an effect of cleaning the workpiece surface so as to facilitate the FeN compounds to deposite on the surface. In general, the process is carried out under a vacuum or an atmosphere of reduced pressure so that consumption of the processing gas is comparatively small and that any risk of air pollution can be avoided. In the process, use may be made of $NH_3$ gas which is dissolved to produce a mixture of nitrogen and hydrogen. Alternatively, a mixture of nitrogen and hydrogen may specially be provided so that an optimum ratio of the two components can be obtained.

In any event, it has been a common practice to maintain the ratio of nitrogen gas to hydrogen gas substantially constant throughout the process. For the ion-nitriding process, it is essential to provide a stabilized or steady glow discharge so that a uniform temperature distribution is established and, for the purpose, it is recommendable to maintain the nitrogen-to-hydrogen ratio as small as possible. However, where the workpiece is of a complicated configuration having narrow openings such as narrow slits or narrow apertures, there is a tendency that, under an atmosphere of comparatively small nitrogen-to-hydrogen ratio, the glow discharge cannot extend deep into the openings because the size or width of glow is increased as the ratio decreases. Thus, it becomes difficult to accomplish the nitriding through the ion-nitriding process under a small nitrogen-to-hydrogen ratio particularly at such narrow openings.

It may be possible to effect nitriding of such narrow openings through the ion nitriding process with a comparatively large nitrogen-to-hydrogen ratio, however, such solution is not recommendable since a steady or stabilized glow discharge cannot be established under a large nitrogen-to-hydrogen ratio. Where the ratio is not adequately small, there is a tendency that appreciable extent of arc discharge is produced, as soon as a DC voltage is applied, through surface contaminating matters such as oils and dusts which may remain on the workpiece surface even when the surface is carefully pretreated by for example cleaning or buffing. Such arc discharge is particularly apt to be produced in the areas of the narrow openings and causes a local destruction of the workpiece material. Hithertofore, in order to eliminate the above problems, it has been required to apply to the workpiece an extremely careful pretreatment which is expensive and requires an extended time.

It is therefore an object of the present invention to provide an ion-nitriding process through which even an area of narrow opening can be nitrided without any appreciable problem.

Another object of the present invention is to provide an ion-nitriding process which can effectively be applied to a workpiece having narrow openings.

In order to accomplish the above and other objects, the ion-nitriding process in accordance with the present invention is comprised of two essential steps. In the first step, the workpiece having at least one narrow opening is placed in an atmosphere containing nitrogen and hydrogen under a vacuum, the ratio of nitrogen to hydrogen being small enough to suppress arc discharge and provide a steady glow discharge. The workpiece is thereafter subjected to a discharge voltage so that a glow discharge is produced substantially throughout at least the exposed surface of the workpiece. The exposed surface is then formed with a nitrided layer under a substantially uniform temperature distribution. In the second step, the nitrogen-to-hydrogen ratio is increased to such a value that the glow discharge can be extended into the opening and the workpiece is again subjected to the discharge voltage to effect nitriding at the opening area. It should of course be noted that in the second step the glow discharge may also be produced in the surface area to effect a further nitriding therein.

In the first step, the ratio of nitrogen gas to hydrogen gas may be 1:5 to 1:1 and in the second step the amount of nitrogen gas may be increased so that the ratio becomes 1:1 to 5:1.

The above and other objects and features of the present invention will become apparent from the following descriptions of a preferred embodiment taking reference to the accompanying drawings, in which.

Figure 1:
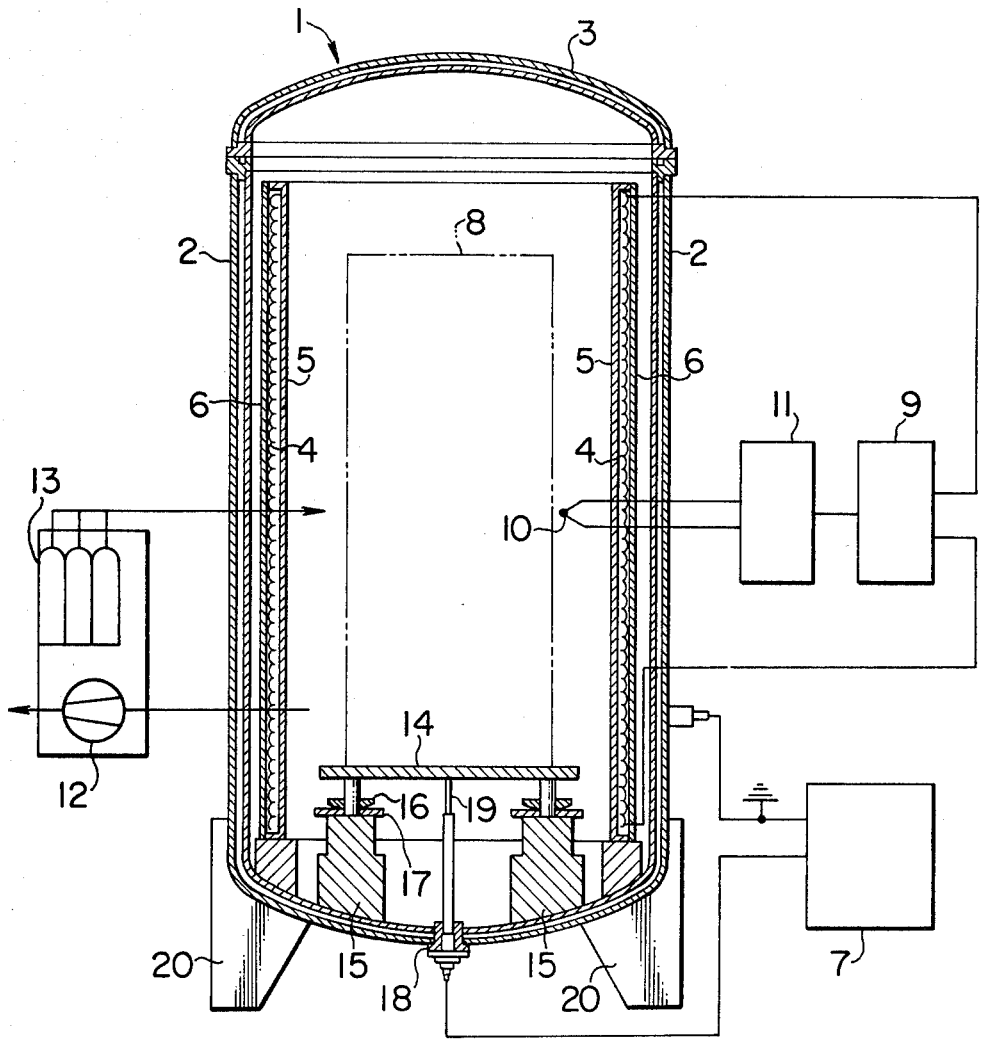
FIG. 1 is a diagrammatical illustration of an ion-nitriding apparatus which may be used for carrying out the process in accordance with the present invention.

Referring to the drawings, particularly to FIG. 1, the apparatus shown therein includes a nitriding tower 1 which is comprised of a cylindrical casing 2 and an upper closure 3 gas-tightly secured to the upper end of the casing 2. The casing 2 and the closure 3 are of double-walled constructions to provide cooling water jackets therein. In the tower 1, there is disposed a cylindrical heat radiating element 4 which may be constituted by a graphite cloth or any other suitable material. The heat radiating element 4 is positioned between inner and outer shields 5 and 6. The inner shield 5 is made of an electrically conductive material and functions to electrically shield the element 4 from the the worktable 14 and the workpiece 8.

Within the inner shield 5, there is provided a work table 14 which is made of a conductive material and supported on an electrically insulative base 15 through conductive discs 16 and insulative plates 17. The table 14 is connected with a cathode terminal 19 which is mounted on the casing 2 through a fitting 18. The casing 2 is supported on legs 20.

A glow discharge power source 7 is connected on one hand with the inner shield 5 through the casing 2 and on the other hand with the table 14 through the cathode terminal 19 so that the inner shield 5 functions as an anode and the table 14 as a cathode. A workpiece 8 is placed on the table 14 as shown by a phantom line in FIG. 1. The power source 7 provides a supply of electric power in a manner that the discharge voltage, the duration time of discharge and the discharge wave form arc appropriately controlled.

The heat radiating element 4 is connected with an AC power source 9 which is controlled by means of a temperature control device 11 having a temperature sensing thermocouple 10. The temperature in the casing 2 is therefore sensed by the thermocouple 10 and the temperature control device 11 controls the AC power source 9 in accordance with the temperature sensed by the thermocouple 10.

The inside of the casing 2 is further connected with an evacuating pump to apply a vacuum pressure to the tower 1. The inside of the casing 2 is also connected with a gas supply device 13 which supplies nitrogen and hydrogen gases in a controlled manner.

Figure 2:
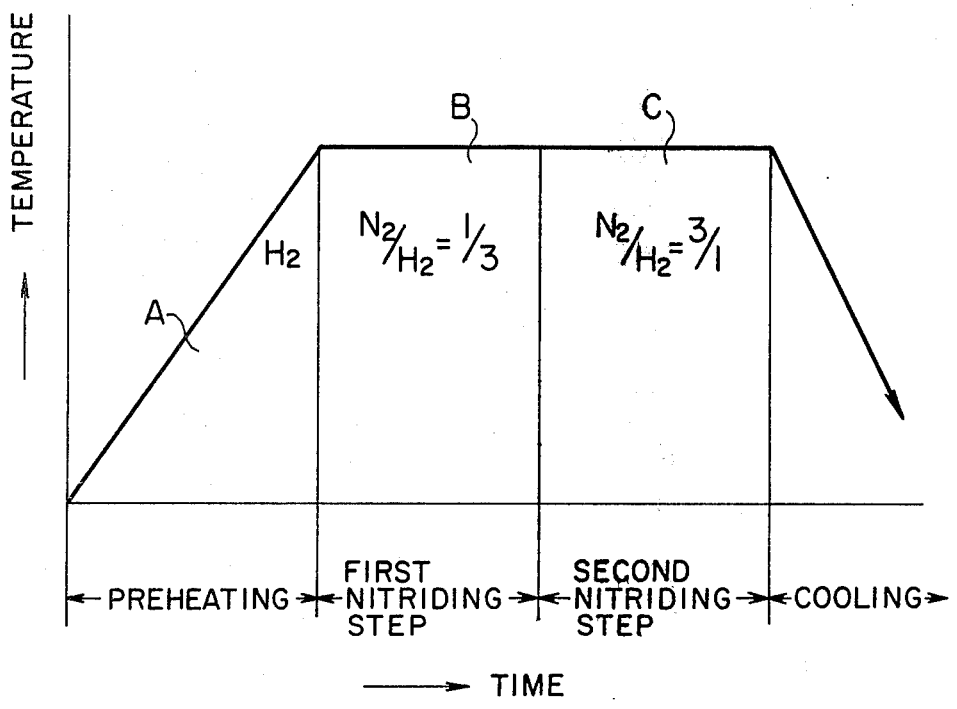
FIG. 2 is a diagram showing a typical example of the process in accordance with the present invention.

In operation, the evacuating pump 12 is at first operated to evacuate the tower 1 so that a vacuum pressure of, for example, 1 to 10 Torr is maintained therein. Then, hydrogen gas is supplied to the tower 1 by the gas supply device 13 and the power source 9 is energized to generate heat in the element 4. At the same time, the power source 7 is energized so that a DC voltage is applied between the inner shield 5 and the table 14 to produce a glow discharge. The workpiece 8 is then heated by the glow discharge and the heat generated at the element 4, to a temperature between 300° and 570° C., preferably 550° and 560° C., under which the workpiece 8 can readily be nitrided. The glow discharge further has an effect of cleaning the workpiece surface through a reducing function. The step is shown in FIG. 2 by an area A.

Then, the first nitriding step is carried out by applying into the tower 1 a mixture of nitrogen and hydrogen with the vacuum pressure in the tower maintained between 1 and 5 Torr. The mixing ratio of nitrogen to hydrogen may be between 1:5 and 1:1 and properly determined so that arc discharge on the workpiece can adequately be suppressed. The workpiece 8 is maintained at a desired temperature by means of the heat generated by the element 4 under the control of the device 11, and the DC voltage applied from the power source 7 is increased until a glow discharge is produced. Since the nitrogen-to-hydrogen ratio is small, a stable glow discharge is produced on the exposed surface of the workpiece 8 except those areas where relatively narrow openings such as small holes or slits exist. Generation of arc is significantly suppressed and a uniformly nitrided layer is formed. In this instance, the size or width of the glow discharge is relatively large due to the small mixture ratio so that the discharge glow bridges the openings in the workpiece and the insides of the openings cannot be nitrided.

The recommendable value of the nitrogen-to-hydrogen ratio depends on the strength of the vacuum in the tower 1. When the vacuum is relatively weak, the amount of nitrogen should be decreased with respect to hydrogen. However, when the vacuum is sufficiently strong, nitrogen may be increased. The first nitriding step is shown by the area B in FIG. 2.

Thereafter, the second nitriding step is carried out under an increased nitrogen-to-hydrogen ratio. In this step, the size or width of the glow is reduced due to the increased gas ratio so that the glow can extend into the openings such as small holes and narrow slits. Thus, nitriding is carried out in the areas where such openings exist. In this instance, since the exposed surface area of the workpiece has already been nitrided through the first nitriding step, there is least possibility that discharge arc is produced in the surface area even under the increased gas ratio in this second nitriding step. Further, the insides of the openings have relatively small surface area so that there is less possibility that discharge arc is produced therein even under a large gas ratio. Thus, it is possible to suppress generation of discharge arc as small as possible while providing a nitrided layer throughout the surface of the workpiece including the exposed surface and the insides of the openings. The gas ratio under which the second nitriding step is carried out may depend on the size of the openings but a preferable range is 1:1 to 5:1. In the second nitriding step, the vacuum may be weakened. Then, the size of the glow is further decreased so that the discharge glow can be extended into even fine openings. The step is shown by the area C in FIG. 2. After the second nitriding step, the workpiece is cooled.

EXAMPLE 1

Figure 3:
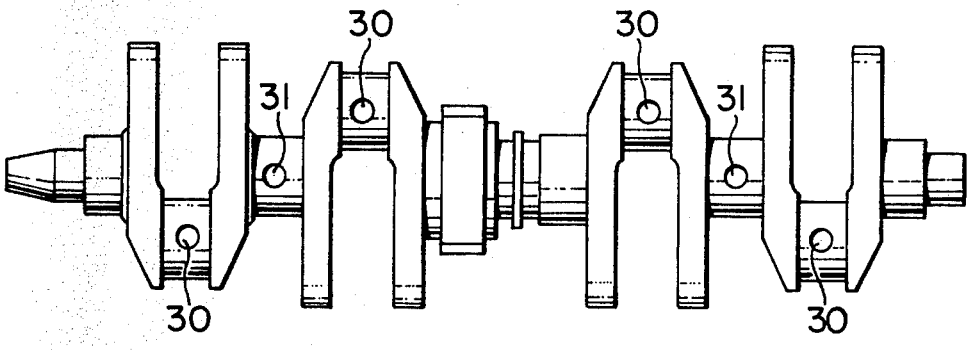
FIG. 3 is an elevational view showing a crankshaft to which the process of the present invention can be applied; and, FIG. 4 is a sectional view of a test piece.

A crankshaft for a motorcycle engine as shown in FIG. 3 was ion-nitrided in accordance with the present invention. The crankshaft had through holes 30 of 4 mm in diameter in the crankpins and through holes 31 of 5 mm in diameter in the shaft portion. In the first step, the workpiece was heated to 550° C. in an atmosphere of hydrogen under a vacuum of 1 Torr and then the first ion-nitriding step was carried under the atmosphere of a mixture of nitrogen and hydrogen having the nitrogen-to-hydrogen ratio of 1:3, the atmosphere being mantained at a vacuum pressure of 1 Torr. After 2 hours of the first nitriding step, the nitrogen-to-hydrogen ratio was increased to 3:1 and the second ion-nitriding step was carried out for two hours under the same vacuum. It has been observed that in the first nitriding step stable discharge glow is produced in the exposed surface of the workpiece except the inside areas of the through holes without producing any appreciable arc discharge. In the second nitriding step, it has been observed that stable discharge glow is extending into the inside areas of the through holes and there was no appreciable arc discharge.

EXAMPLE 2

Figure 4:
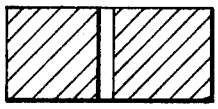

A test piece as shown in FIG. 4 having a thickness of 30 mm and formed with a through hole of 4.0 mm in diameter was nitrided in accordance with the present invention. The testpiece was maintained at 550° C. during the process. Throughout the process, a vacuum of 1 Torr was maintained. In the first nitriding step, the nitrogen-to-hydrogen ratio was maintained at 1:4 and in the second nitriding step the ratio was increased to 1:1. As in the Example 1, a satisfactory result was obtained.

The invention has thus been shown and described with reference to specific examples, however, it should be noted that the invention is in no way limited to the details of the examples but changes and modifications may be made without departing from the scope of the appended claims.

We claim:

1. An ion-nitriding process including the steps of subjecting a workpiece having at least one opening area to a DC voltage in an atmosphere of nitrogen-containing gas so as to produce a glow discharge on the workpiece, the process being characterized by a first nitriding step which is carried out in an atmosphere of nitrogen and hydrogen having a mixing ratio of nitrogen to hydrogen which is small enough to suppress arc discharge on the workpiece and a second nitriding step which is carried out under a mixing ratio of nitrogen to hydrogen which is large as compared with the ratio in the first nitriding step so that glow discharge is produced even in the opening area of the workpiece.

2. A process in accordance with claim 1 in which said first nitriding step is preceded by a preheating step which is carried out by producing a glow discharge on the workpiece in an atmosphere of hydrogen.

3. A process in accordance with claims 1, 2, 4 or 5 in which the mixing ratio in the first nitriding step is between 1:5 and 1:1 and that in the second nitriding step is between 1:1 and 5:1, with the proviso that the ratio is not 1:1 for both nitriding steps.

4. A process in accordance with claim 2 in which the workpiece is preheated to a temperature of from 300° to 570° C.

5. A process in accordance with claim 4 in which the workpiece is preheated to a temperature of from 550° to 560° C.

* * * * *